US007971530B2

(12) United States Patent
Otten

(10) Patent No.: US 7,971,530 B2
(45) Date of Patent: Jul. 5, 2011

(54) AUTOMATIC MOUNTING SYSTEM FOR POSITIONING A PLATE ON A CARRIER

(75) Inventor: Petrus Johannes Marie Otten, Vlissingen (NL)

(73) Assignee: AV Flexologic B.V., Alphen aan den Rijn, Netherlands (NL)

( * ) Notice: Subject to any disclaimer, the term of this patent is extended or adjusted under 35 U.S.C. 154(b) by 1018 days.

(21) Appl. No.: 10/593,759

(22) PCT Filed: Mar. 23, 2005

(86) PCT No.: PCT/NL2005/000218

§ 371 (c)(1),
(2), (4) Date: Jun. 7, 2007

(87) PCT Pub. No.: WO2005/090079

PCT Pub. Date: Sep. 29, 2005

(65) Prior Publication Data

US 2007/0261580 A1 Nov. 15, 2007

(30) Foreign Application Priority Data

Mar. 23, 2004 (NL) ..... 1025791

(51) Int. Cl.
*B41F 27/12* (2006.01)

(52) U.S. Cl. .. 101/477; 101/481; 101/486; 101/DIG. 36

(58) Field of Classification Search ..... 101/477, 101/481, 485, 486, DIG. 36
See application file for complete search history.

(56) References Cited

U.S. PATENT DOCUMENTS

| | | | | |
|---|---|---|---|---|
| 4,872,407 | A * | 10/1989 | Banke | 101/389.1 |
| 5,132,911 | A | 7/1992 | Leader, Jr. et al. | |
| 5,485,782 | A | 1/1996 | Van Der Horst | |
| 5,488,781 | A | 2/1996 | Van Der Horst | |
| 6,055,908 | A * | 5/2000 | Van Der Horst | 101/486 |
| 6,823,793 | B2 * | 11/2004 | Dewitte | 101/485 |
| 2005/0028702 | A1 | 2/2005 | Otten | |
| 2006/0117973 | A1 * | 6/2006 | Zanoli et al. | 101/216 |

FOREIGN PATENT DOCUMENTS

| | | | |
|---|---|---|---|
| DE | 8912428 | U1 | 2/1991 |
| EP | 0922578 | A1 | 6/1999 |
| EP | 1435291 | A1 | 7/2004 |
| NL | 1007631 | C2 | 6/1999 |

OTHER PUBLICATIONS

International Search Report and Written Opinion of the ISA/EP for International Application No. PCT/NL2005/000218, dated Aug. 19, 2005, 7 pages.

International Preliminary Report on Patentability for International Application No. PCT/NL2005/000218, dated Oct. 5, 2006, 7 pages.

* cited by examiner

*Primary Examiner* — Leslie J Evanisko

(74) *Attorney, Agent, or Firm* — McDonnell Boehnen Hulbert & Berghoff LLP

(57) ABSTRACT

The invention relates to a method and a device for positioning a flexible printing plate on a carrier, comprising the following steps of: placing on a table the flexible printing plate for positioning; determining the position of the printing plate by means of a visual display device; and depending on the position, moving the printing plate to its end position on the carrier, wherein the position of the carrier is sensed in the vicinity of the final position and the carrier is moved to its end position depending on the position sensed in the vicinity of the final position. The positioning takes place much more accurately as a result of these measures.

11 Claims, 5 Drawing Sheets

AUTOMATIC MOUNTING SYSTEM FOR POSITIONING A PLATE ON A CARRIER

BACKGROUND

The present invention relates to a method for positioning a flexible printing plate on a carrier, comprising the following steps of: placing on a table the flexible printing plate for positioning, determining the position of the printing plate by means of a camera and, depending on the position, moving the printing plate to its end position on the carrier.

The present invention also relates to a device for positioning a printing plate on a carrier, comprising a table for positioning the at least one printing plate for positioning, support means for supporting the carrier on which the printing plate must be positioned, at least one camera for recording the image of the printing plate, a manipulator for transporting the printing plate from the table to a carrier placed on the support means, and a control means which is adapted to control the manipulator and which is connected to the camera to obtain signals coming from the camera.

Such a method and such a device are known from Netherlands patent application no. 1 007 631.

In this prior art method and in this prior art device a printing plate for positioning is placed on a table, whereafter the position of the printing plate on the table is determined. It is then determined over which distance and in which direction the printing plate must be moved so that it comes to lie at its desired position on the carrier. Once this displacement, which can otherwise comprise not only a linear displacement but also a rotation, has been determined it is carried out. Use is made for this purpose of a manipulator which forms part of the device in question.

SUMMARY

It has been found by the inventors of the present method and device that the accuracy of the position of the printing plate eventually reached on the carrier does not meet the desired requirements of accuracy. It is of the greatest importance, particularly in colour printed material, that the printing plates are mounted in register on the carrier so that the colours are printed in register. The accuracy achieved with this prior art method and device is insufficient for the increasingly higher standards also being made of flexible printing.

The present invention has for its object to provide such a method and device wherein the positioning of the printing plate takes place more accurately.

This object is achieved by such a method, wherein the position of the carrier is sensed in the vicinity of the final position and wherein the carrier is moved to its end position depending on the position sensed in the vicinity of the final position. It is noted here that sensing the position of the carrier is understood to mean determining the location of the carrier and/or orientation of the carrier.

This object is likewise achieved by such a device, wherein at least one camera is placed for sensing the printing plate in the vicinity of the support means.

As a result of these measures the positioning takes place much more precisely. In the prior art situation the comparison between the actual position of the printing plate on the table and the finally desired position of the printing plate on the carrier takes place at a great distance from each other so that the manipulator must transport the printing plate over a great distance after carrying out the reference. The desired accuracy cannot be achieved as a result of, among other things, the play in the manipulator, inaccuracy in control of the manipulator and the like.

In the present invention however, the comparison between the actual position of the printing plate and the desired position of the printing plate takes place much closer to the desired position, so that the printing plate need only be moved a short distance. In a further preferred embodiment, the final position of the printing plate is moreover situated within the "field of vision" of the camera so that a comparison can be carried out until the final position has been determined. The final accuracy of the position is hereby determined by the resolution of the camera and of the image present for purposes of comparison in the memory of the control device, and no longer as much by mechanical properties of the manipulator or of the operating person. It hereby becomes possible to achieve exceptionally great accuracy. Another advantage of the invention is the fact that this allows a high level of automation so that positioning can be carried out without human intervention.

The comparison between the actual position of the printing plate and the desired end position of the printing plate preferably takes place in a digital device coupled to the camera. This enhances the above stated advantages.

Another preferred embodiment provides the measure that the displacement is controlled subject to the result of the comparison. The adjustment already referred to above hereby takes place with the above stated result.

In a further embodiment the method comprises of repeating the sensing of the position of the carrier and comparing the sensed position to the end position until the end position has been achieved sufficiently accurately, for instance within a predetermined margin.

In a further preferred embodiment, placing on a table of the flexible printing plate for positioning and determining of the position of the printing plate by means of a visual display device take place simultaneously, so that a considerable time-saving can be realized in positioning of the printing plate.

Yet another preferred embodiment provides the measure that several printing plates stacked on top of each other on the table are positioned successively.

Such a method is for instance attractive when several printing plates must be placed on a carrier, or when the printing plates are arranged on a flexible foil. In order to increase the mounting speed it is therefore attractive in this case for the printing plates to be placed in a stack on the table, whereafter they can be positioned successively.

According to a preferred embodiment of the device, the control device is adapted to transport the printing plate, independently of the image displayed by the at least one camera, from the table to that part of the machine being recorded by the at least one camera.

Use is hereby made of the fact that the machine "knows" where the printing plate must be moved, i.e. to the field of vision of the camera, whereafter, once the camera has the printing plate "in view", this machine can move the printing plate precisely to the desired position as a result of the comparison with the desired position.

It is attractive for this purpose that the control device is adapted to compare the recorded image to an image stored in the memory.

The use of image comparison software provides the option of adapting the control device to compare images of printing plates without markings.

In a particular embodiment of the manipulator, use is made of a displaceable carriage with pick-up device, which preferably comprises one or more suction cups with which a printing plate can be picked up and displaced to the carrier. When the printing plates are for instance provided with tape or another adhesive material, this embodiment ensures that the printing plates can be picked up and transported to the correct position with great certainty.

In another preferred embodiment the manipulator comprises a displaceable pressing element for co-displacing the printing plate to the carrier by friction. With this construction the plate more readily remains flat than in the above stated embodiment.

Other attractive embodiments are stated in the remaining sub-claims.

BRIEF DESCRIPTION OF THE DRAWINGS

The present invention will be elucidated hereinbelow with reference to the accompanying figures, in which.

DETAILED DESCRIPTION

Figure 1:
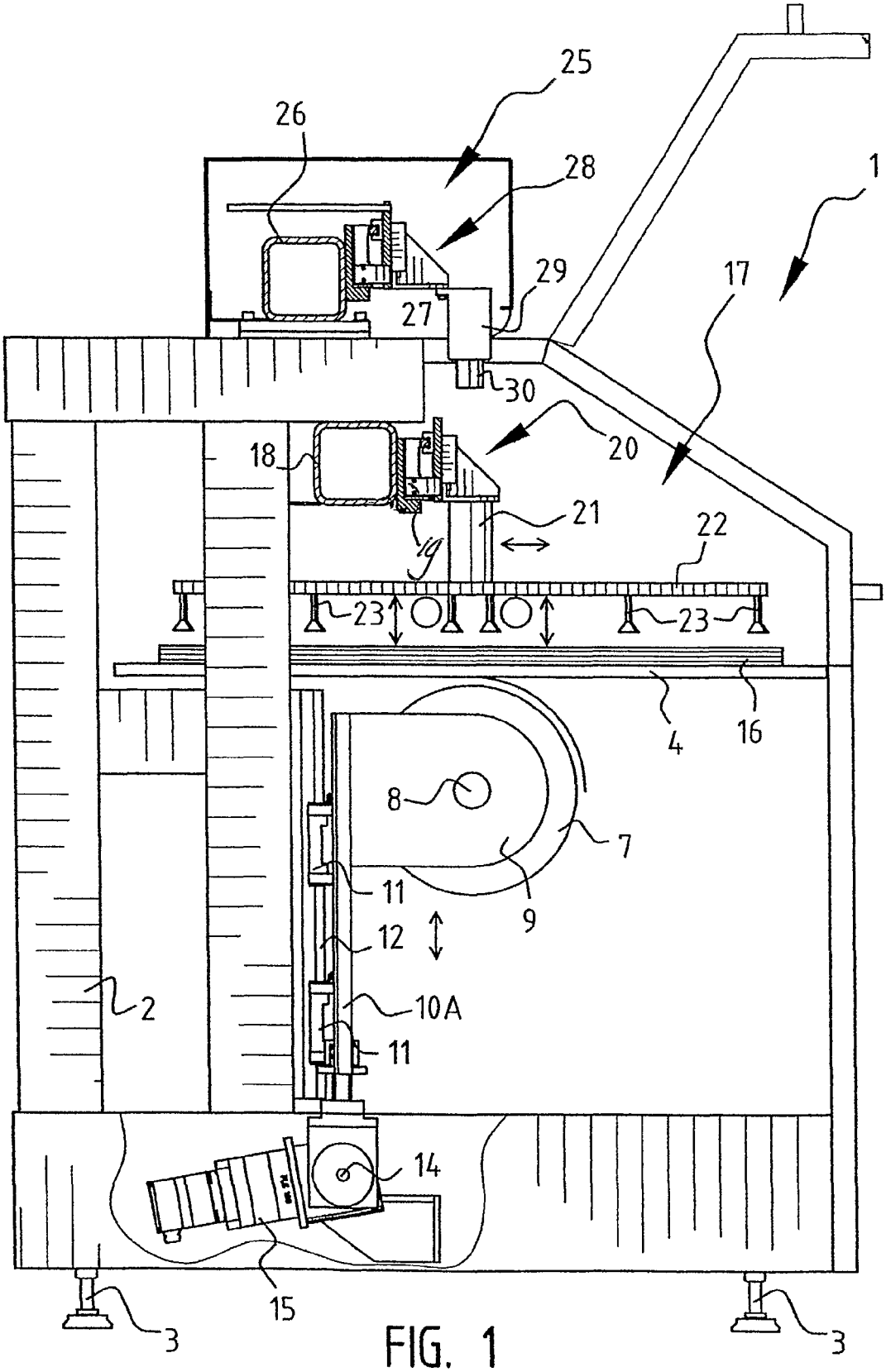
FIG. 1 is a side view of a device according to the present invention which is preferably used in performing a method according to the present invention.
Figure 2:
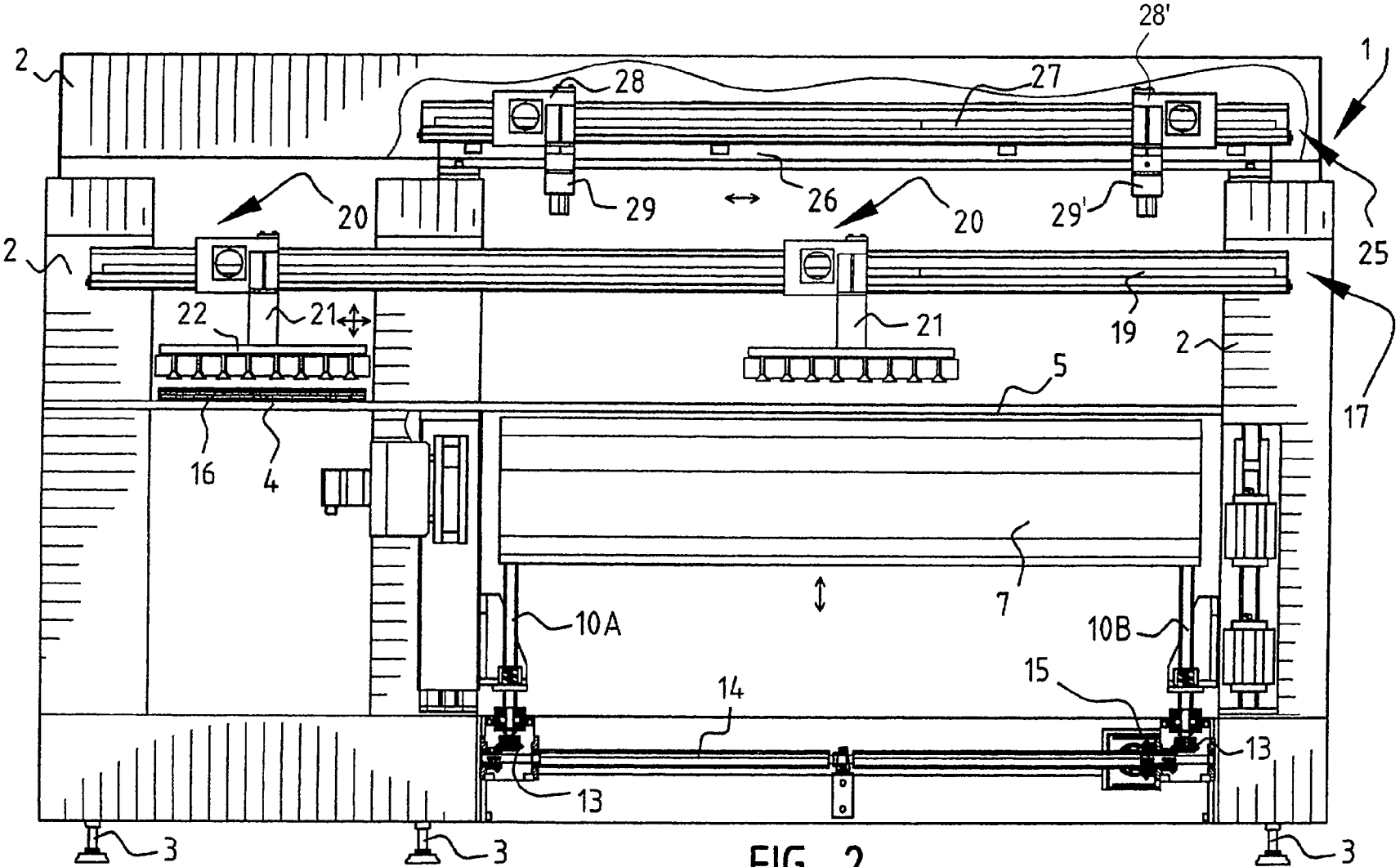
FIG. 2 is a front view of the device shown in FIG. 1.
Figure 3:
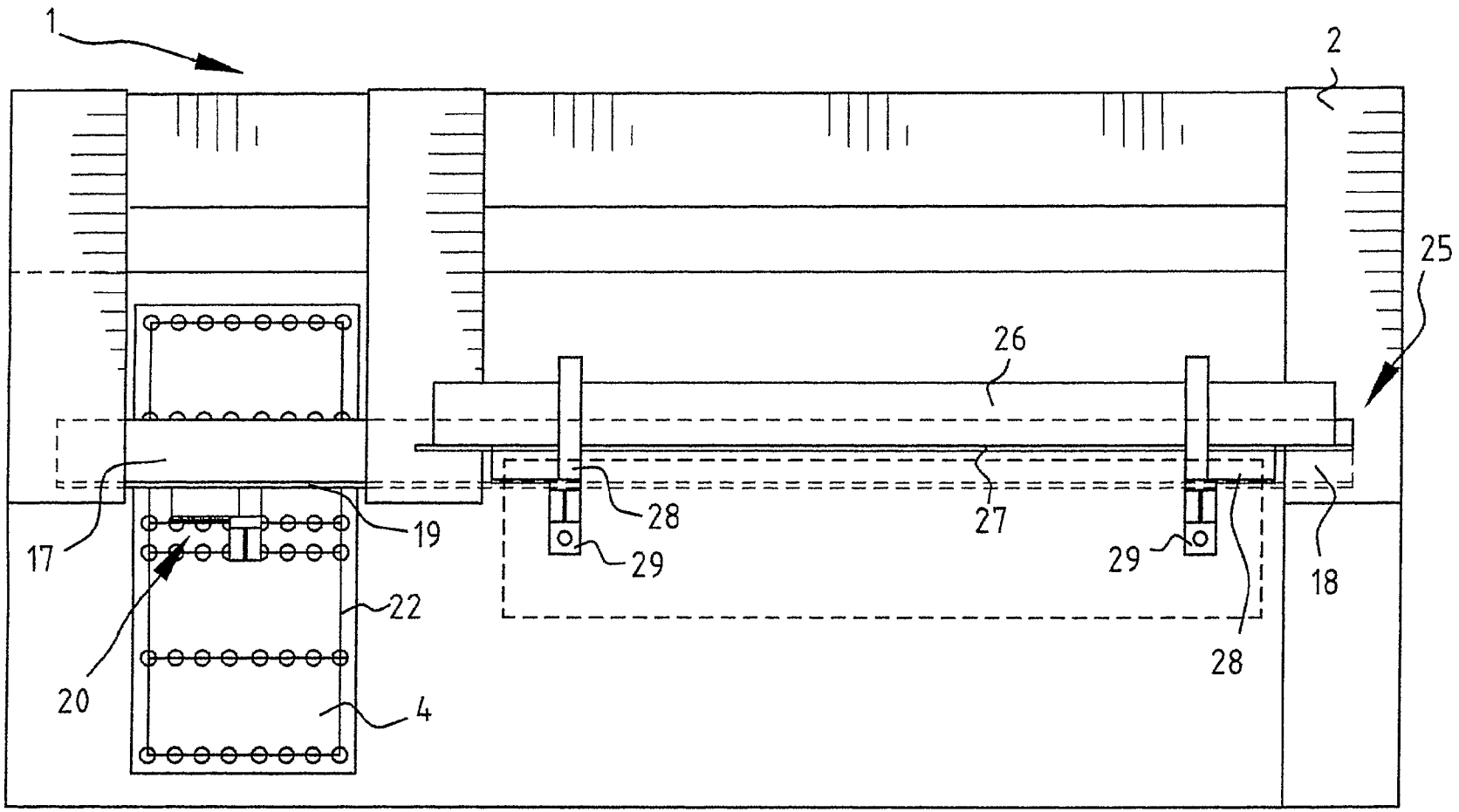
FIG. 3 is a top view of the device shown in FIGS. 1 and 2.

The device 1 shown in FIGS. 1, 2 and 3 comprises a frame 2 manufactured from profiles and having a substantially rectangular configuration. Frame 2 rests on a number of adjustable legs 3 which serve to enable horizontal arrangement of the frame. The frame comprises a table 4, shown on the left in the top view of FIG. 3 and the front view of FIG. 2, on which a stack of printing plates 16 for positioning can be placed.

A mounting table 5 is moreover fixed to the frame and can be seen in the front view of FIG. 2. In this mounting table is arranged a recess through which pressure roller 7 mounted under mounting table 5 is accessible from above.

Pressure roller 7 is suspended by means of its shaft 8 from two brackets 9 which are each fixed to a plate 10A, 10B respectively which is movable in vertical direction. Both plates 10A, 10B are mounted on a spindle 12 by means of bearing supports 11. The height of brackets 9, and thereby that of pressure roller 7, can be adjusted by driving the spindle 12. So as to ensure the horizontal position of pressure roller 7, driving of spindles 12 takes place synchronously. For this purpose they are each connected by means of a conical gear connection 13 to a joint, horizontally extending shaft 14 which can be driven by means of a drive device 15.

For transport of printing plates 16 for positioning use is made of a manipulating device designated as a whole with 17. The manipulating device comprises a horizontally extending profile with a rectangular section 18, on which is fixed a steel profile 19. Steel profile 19 herein serves to prevent sagging of the profile and to obtain the strength essential at this accuracy. A carriage 20 is movable along the substantially L-shaped steel profile 19. The carriage is provided with an electric motor and a drive whereby this carriage can advance along steel profile 19. An arm 21 extending substantially in vertical direction is mounted on carriage 20. Arm 21 is movable along the carriage in vertical direction by means of a drive device, not shown in the drawing, which is likewise provided with an electric motor.

On the underside of arm 21 is fixed a frame 22 which extends substantially in a horizontal plane. A number of suction cups 23 is attached to the underside of the frame. Using the suction cups the printing plates 16 can be engaged on their relatively flat upper side. Suction cups 23 are preferably of the controllable type, i.e. the pressure can be released so that they lose their suction force. They are all connected for this purpose to a controllable valve, not shown in the drawing, by means of air hoses not shown in the drawing. It is possible in principle to make use of other pick-up devices. Further arranged in carriage 20 is a mechanism, not visible in the drawings, which serves to move frame 22 in horizontal direction transversely of the longitudinal direction of profile 19.

Although likewise not shown in the drawing, it is also possible to have the frame 22 rotate relative to the axis of rod 21. It is thus possible to cause printing plate 16 to translate in all three directions and to rotate about one axis. Provided that correct control is applied, it is possible with this manipulating device to place a printing plate 16 precisely at the desired location on mounting table 5.

In order to check whether the printing plate is indeed situated at its correct position, use is made of a visual recording device designated as a whole with 25.

Visual recording device 25 is again formed by a steel rectangular profile 26 on which is fixed an L-shaped steel profile 27. Use is preferably made here of the same profiles as for the profiles of the manipulator. This is not essential however. Here too the steel profile serves to provide sufficient rigidity. Carriages 28, 28' are movable along the steel L-shaped profile 27 in the present case 2. It is however also possible to make use of only a single carriage. The choice between one or two carriages depends on the maximum size of the printing plates for mounting and on the optical properties of the cameras mounted on the carriages and to be further elucidated.

Mounted on each carriage 28,28' is a camera 29,29', the lens 30 of which is directed downward. On both carriages 28,28' is arranged an electric motor for moving the carriage along steel profile 27.

In the present embodiment there is no provision for the cameras to be movable in the direction transversely of the longitudinal direction of the profile. This is related to the optical properties of the cameras; embodiments can of course be envisaged wherein this is however the case.

When the difference in dimensions between the printing plates is not too great, the at least one camera can also be arranged on the profile in stationary manner, at least when the field of vision of the camera allows this.

For control of the manipulator, optionally the cameras, and of the height adjustment of pressure roller 7, use is made of a computer which is not shown in the drawing but which is incorporated in the device according to the invention. This computer is programmed to control the above stated elements such that the device can be used to perform the method according to the present invention, and wherein the device can meet the demands made of a device according to the present invention.

In order to perform the method according to the present invention with the device according to the present invention, one printing plate 16 or a number of printing plates 16 is/are placed on table 4.

The data associated with these printing plates, such as the dimensions of the printing plate, the location of positioning markings possibly present on the printing plate and the coordinates of the location at which the printing plate must be placed, are furthermore entered into the memory of the computer of the device.

It is however possible to use printing plates wherein no positioning markings are present and wherein use is made of an image in digital form of the printing image present on the printing plate. During the positioning use is made here of image recognition software to place the printing plate at the correct position.

Once the computer has been informed regarding the relevant properties of the printing plate as mentioned above, the computer will control the manipulator such that frame 22 is situated at the position above the uppermost printing plate 16. By moving the frame downward the suction cups 23 will come into contact with and pick up the printing plate. The picked-up printing plate is then moved slightly upward and will then move under the control of the computer to the area where the printing plate must be mounted, i.e. above pressure roller 7. While the first part of this route is being covered, no reference relating to the correct position as yet takes place; this is merely a rough movement over a great distance.

The computer is moreover adapted to control one or both cameras 29 so that the area which they view, designated hereafter as "field of vision", extends over the position of the printing plate for positioning.

When the above mentioned rough movement is carried out, the printing plate will move within the field of vision of the camera or cameras. It then becomes possible for the cameras to carry out a comparison between the actual position of the printing plate and the desired position of the printing plate. The desired position is after all stored in the memory of the digital device, while the cameras sense the actual position of the printing plate. Use can be made for this purpose of the positioning markings present on the printing plate, although use can also be made of the image of the printing plate. The printing plate is moved to its final position by applying suitable software.

When the desired position has almost been reached, the cameras can here zoom in so as to thus achieve the greatest possible accuracy. When the desired position is obtained, the device generates a signal and fixation on the carrier can take place. In the above stated embodiment this carrier is formed by pressure roller 7, although it is equally possible to make use of a flexible carrier, for instance in the form of a foil. The carrier is herein preferably provided beforehand with an adhesive to enable adhesion of the printing plate to the carrier.

The above described procedure relates to the arranging of a single printing plate. It will be apparent that this procedure can be applied repeatedly to position a large number of printing plates placed beforehand in a stack on table 4.

The carrier, when provided with a printing plate, will herein have to be displaced. When the carrier is formed by the cylinder, it will for instance have to be rotated which, if the device is adapted for this purpose, can also take place by means of a relevant device under the control of the computer. When the carrier is formed by foil, it can be moved further in the direction transversely of the longitudinal direction of the profiles. A suitable winding device can for instance be applied for this purpose.

FIGS. 4 and 5A-5D show a second preferred embodiment of the invention. In this embodiment use is made for the greater part of the device described in respect of the first embodiment. Reference numerals for similar components of the device according to the second embodiment correspond with the reference numerals introduced above. Description of the embodiment, where identical to that of the first embodiment, is omitted here.

Figure 4:
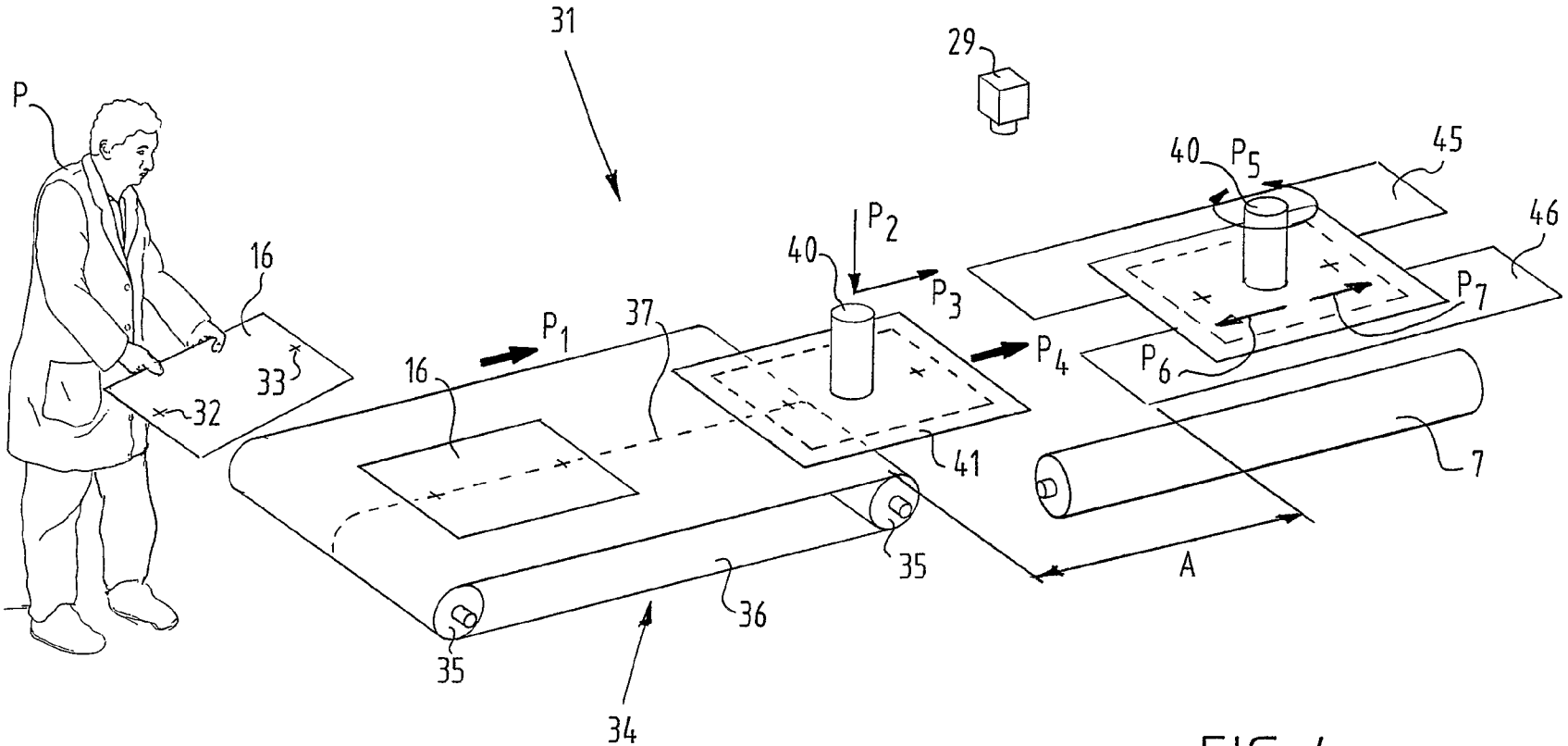
FIG. 4 is an exploded schematic view of a second preferred embodiment of the device according to the present invention which is preferably used in performing the method according to the present invention.

FIG. 4 shows an exploded perspective view of the second preferred embodiment, wherein the left-hand part, the middle part and the right-hand part show successive stages of the method according to the invention. Instead of a manipulating device 17 provided with suction cups for picking up the printing plates, an alternative manipulating device 31 is provided. According to the present invention printing plates 16 are transported on a conveyor 34, which comprises an endless conveyor belt 36 which runs on rollers 35 and which is driven (in direction $P_1$) by means of one or more drive motors. An operative P manually places a printing plate 16 on conveyor 34, this such that the front marking 33 and rear marking 32 on printing plate 16 are positioned approximately on the aligning line 37 indicated on conveyor belt 36. After being placed on the conveyor belt, the printing plate is carried in the direction of pressure roller 7 (direction $P_1$).

At a given moment the printing plate 16 comes to lie at a manipulator unit 40 which is provided with a horizontal plate-like element 41. Manipulator unit 40 presses element 41 downward (in direction $P_2$). The flat element 41 of manipulator unit 40 presses printing plate 16 downward. Manipulating device 40 is displaced in forward direction ($P_3$). As a result of the friction between element 41 and printing plate 16 the latter is carried along by manipulator unit 40 ($P_4$) until two table parts 45, 46 of a mounting table are reached.

In practice the distance A between the end of conveyor 34 and the beginning of mounting table 45, 46 will be about 30 to 40 cm, so that the printing plate always rests at least on conveyor 34 or mounting table 45, 46. In the exploded view of FIG. 4 this distance is however drawn somewhat greater than is the case in reality.

During displacement of printing plate 16 from conveyor 34 to mounting table 45, 46 image recognition takes place via the camera 29 arranged above the whole. Element 41 can be provided for this purpose with one or more apertures (not shown) so that a part of the printing plate 16 arranged thereunder becomes visible. On the basis of images recorded by camera 29 the computer calculates the position (i.e. the location and/or the orientation of the plate relative to pressure roller 7) of printing plate 16. The recognition can take place during displacement of the printing plate ("on the fly"). This results in a considerable time-saving. It is of course also possible to have image recognition take place with a stationary printing plate 16.

Once printing plate 16 has arrived on table parts 45, 46 of the mounting table, this situation being shown in the right-hand part of FIG. 4, the manipulator 40, through rotation (direction $P_5$), forward translation (direction $P_7$) and/or rearward translation ($P_6$), will position the printing plate exactly or at least within very small margins of error relative to the manipulating table, and thereby relative to pressure roller 7. Tests have shown that margins of error of ±10 μm can be achieved with the device according to the invention.

Figure 5A:
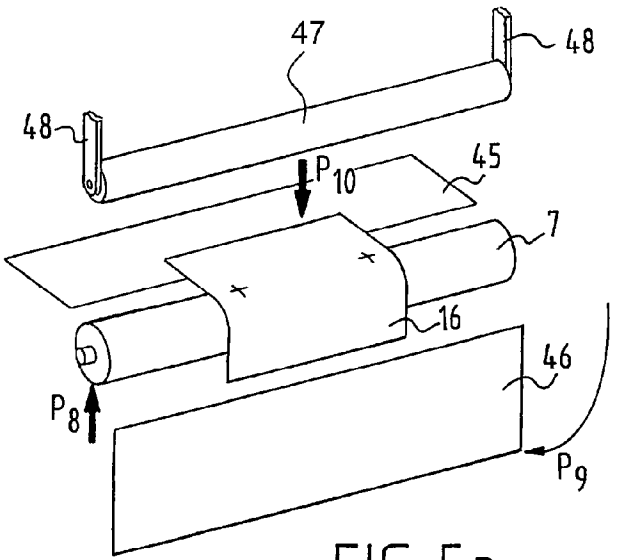
FIGS. 5*a*-5*d* are schematic representations of various steps of the method according to the invention.
Figure 5B:
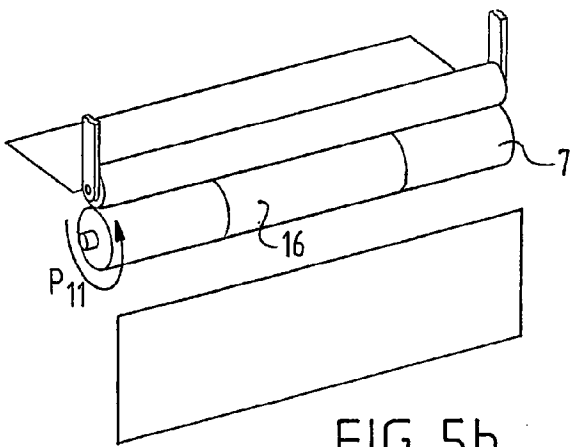
Figure 5C:
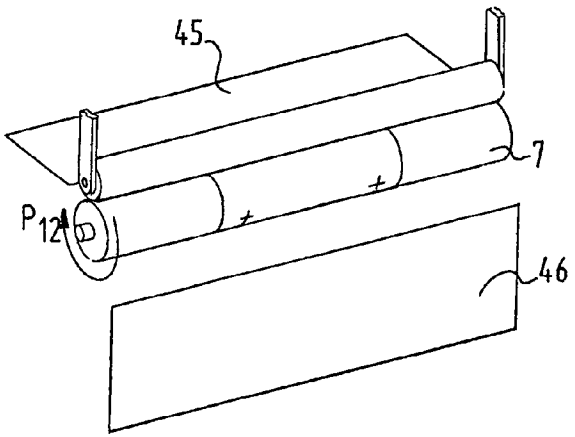
Figure 5D:
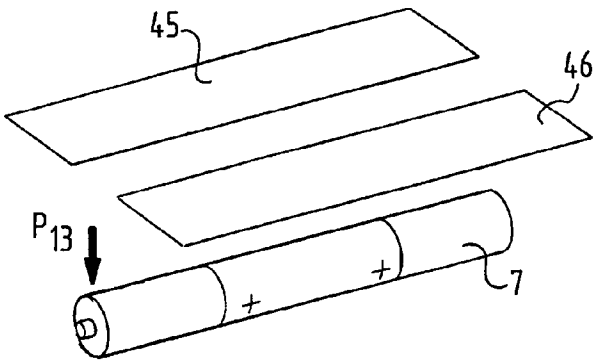

Once printing plate 16 has been positioned in correct manner, pressure roller 7 is displaced upward ($P_8$) to a position against the underside of printing plate 16. One of the table parts, in the shown example table part 46, is then folded downward (direction $P_9$), this such that the associated part of printing plate 16 is wound along pressure roller 7. Simultaneously or shortly thereafter a pressing roller 47, which is arranged on frame 2 using brackets 48, is displaced downward ($P_{10}$) from above until pressing roller 47 comes to rest on the upper side of the printing plate, as shown in FIG. 5A. By now first rotating the roller to the left (direction $P_{11}$) as shown in FIG. 5B, the right-hand part of printing plate 16 is pressed against pressure roller 7, while the left-hand part of printing plate 16 is pressed onto pressure roller 7 when the direction of rotation of pressure roller 7 is reversed (direction $P_{12}$) as shown in FIG. 5C. Finally, the mechanism described above with reference to the first embodiment displaces the pressure roller 7 downward ($P_{13}$) and the downward folded part 46 of the mounting table is folded back again.

It will be apparent that numerous changes can be made to the above described embodiments without departing from the invention.

The invention claimed is:

1. A device for positioning a printing plate on a carrier, comprising (i) a table for placing the printing plate for positioning, (ii) support means for supporting the carrier on which the printing plate is positioned, (iii) at least one camera for recording an image of the printing plate, the at least one camera having a field of vision, (iv) a manipulator for transporting the printing plate from the table to the carrier, and (v) a control means which is adapted to control the manipulator and which is connected to the at least one camera to obtain signals coming from the at least one camera, wherein the at least one camera is placed for sensing a position of the printing plate in the vicinity of a desired final position of the printing plate on the carrier, wherein the at least one camera is located independent from the manipulator, and wherein the control means is adapted to control the transportation of the printing plate, independent of the image displayed by the at least one camera, while the printing plate is being transported from the table to the field of vision of the at least one camera.

2. The device of claim 1, wherein the device is adapted to compare the position of the printing plate and the desired final position of the printing plate.

3. The device of claim 2, wherein the device is adapted to control the position of the printing plate subject to the result of the comparison.

4. The device of claim 1, wherein the device is suitable for successively positioning several printing plates placed on top of each other on the table.

5. The device of claim 1, wherein the control means is adapted to compare the recorded image to an image stored in memory.

6. The device of claim 5, wherein the control means is provided with software for image comparison.

7. The device of claim 5, wherein the at least one camera is adapted to repeatedly sense the position of the printing plate and wherein the control means is adapted to (i) repeatedly compare the sensed position to the desired final position and to (ii) control the manipulator until the desired final position has been reached with sufficient accuracy.

8. The device of claim 1, wherein the device is adapted to cause the at least one camera to zoom in on the printing plate in order to increase the accuracy of the positioning of the printing plate.

9. The device of claim 1, wherein the manipulator comprises a displaceable carriage with a pick-up device with which the printing plate can be picked up and transported to the carrier.

10. The device of claim 1, wherein the manipulator comprises a displaceable pressing element for transporting the printing plate to the carrier by friction.

11. The device of claim 1, wherein the manipulator and the at least one camera are adapted to position and sense the printing plate simultaneously.

* * * * *